US007182081B2

(12) United States Patent
Reisman

(10) Patent No.: US 7,182,081 B2
(45) Date of Patent: Feb. 27, 2007

(54) PROTECTIVE BREATHING HOOD

(76) Inventor: Ron Reisman, Kibbutz Netzer Sireni, 70395 D.N. Beer Yaacob (IL)

( * ) Notice: Subject to any disclaimer, the term of this patent is extended or adjusted under 35 U.S.C. 154(b) by 0 days.

(21) Appl. No.: 10/506,816

(22) PCT Filed: Feb. 26, 2003

(86) PCT No.: PCT/IL03/00148

§ 371 (c)(1),
(2), (4) Date: Sep. 7, 2004

(87) PCT Pub. No.: WO03/074130

PCT Pub. Date: Sep. 12, 2003

(65) Prior Publication Data

US 2005/0121029 A1 Jun. 9, 2005

(30) Foreign Application Priority Data

Mar. 5, 2002 (IL) ..... 148504

(51) Int. Cl.
*A62B 18/00* (2006.01)
*A62B 19/00* (2006.01)
*A62B 18/10* (2006.01)

(52) U.S. Cl. ..... 128/201.22; 128/201.25; 128/201.28

(58) Field of Classification Search ..... 128/201.17, 128/201.25, 205.27, 205.28, 205.29, 206.12, 128/206.15, 206.16, 206.17, 201.22, 201.28; 55/516, 518, DIG. 35; 96/151
See application file for complete search history.

(56) References Cited

U.S. PATENT DOCUMENTS 4,179,274 A * 12/1979 Moon ..... 55/524
4,233,970 A 11/1980 Kranz
4,807,614 A * 2/1989 van der Smissen et al. ..... 128/201.23
4,870,959 A * 10/1989 Reisman et al. ..... 128/201.25
5,063,926 A * 11/1991 Forsgren et al. ..... 128/206.17
5,140,980 A * 8/1992 Haughey et al. ..... 128/201.25
5,226,412 A * 7/1993 Winters ..... 128/206.12
5,875,775 A * 3/1999 Nur et al. ..... 128/201.28
6,055,983 A 5/2000 Metzger
6,134,716 A * 10/2000 Richardson ..... 2/202
6,158,429 A 12/2000 Gardner et al.
6,701,925 B1 * 3/2004 Resnick ..... 128/206.17
7,007,690 B1 * 3/2006 Grove et al. ..... 128/201.25
2003/0131846 A1 * 7/2003 Campbell et al. ..... 128/201.25

FOREIGN PATENT DOCUMENTS

EP 0 356 000 A2 2/1990
GB 2 105 177 A 3/1983
GB 2 191 958 A 12/1987

* cited by examiner

*Primary Examiner*—Teena Mitchell
*Assistant Examiner*—Amadeus Lopez
(74) *Attorney, Agent, or Firm*—The Nath Law Group; Jerald L. Meyer; Stanley N. Protigal

(57) ABSTRACT

A protective breathing hood comprising a hood made of a stretchable fire resistant material and which is also impermeable to gases and biologic material. The hood is sized and shaped for placing over a head of a user in an airtight manner with an opening of the hood scalingly engaging a neck portion of the user. At least a visor portion of the hood is transparent and a pair of respiratory units are disposed offset with respect to the nose location. Each respiratory unit comprises a housing formed with an inhalation flow path accommodating activated charcoal particles, and an exhalation flow path fitted with a one way exhaling valve, wherein at a donned position of the hood a chamber is formed at a mouth/nose location thereof.

31 Claims, 5 Drawing Sheets

PROTECTIVE BREATHING HOOD

FIELD OF THE INVENTION

The present invention is concerned with a protective breathing hood. In particular, the invention is concerned with a protective device collapsible into a pocket-sized article readily available and easily donned for protecting an individual from the risk of inhaling hazardous material, e.g. poisonous gases and biologic material.

BACKGROUND OF THE INVENTION

Protective breathing hoods and masks are well known and a large variety of such articles are available. These are used to ensure safe breathing in hazardous situations in which harmful or deadly gases are generated or at the environment of biologic material, e.g. in the event of fire emergencies, chemical or biological industrial disasters or in case of terror or warfare attacks.

Professional protective breathing equipment is used by professionals such as fire fighters, military units and is also known to be provided to citizens of some countries in which chemical/biologic war threat exists. Such equipment is typically more cumbersome and is used to provide prolonged protection and in harsh conditions.

Recently, there has been ever growing interest in readily available, lightweight, portable protective breathing equipment for use by civilians and which may be easily carried daily, e.g. in a purse, bag or readily stored at office buildings, etc. Such devices are designed for easy donning in case of an emergency, e.g. outbreak of a fire, leak of some chemical substance or in case of a terror attack in which biological warfare agents such as anthrax germs are spread. In such instances time is a critical factor in survival.

For example, in case of fire breakout in buildings occupying many people such as large office buildings, hotels, and halls, where many people gather simultaneously, it may take a while until the professional teams arrive, e.g. fire fighters, hazardous-material professionals, etc., whereby it is advantageous that each and every person carry with him, or be readily provided with a protective breathing mask.

U.S. Pat. Ser. No. 4,870,959 discloses a protective breathing mask comprising a fire-resistant stretchable material shaped as a hood for wearing over and enclosing the head, fitted with a visor portion and with filter materials sealingly attached to the stretchable material wherein the filtering material comprises a plurality of fire-resistant flexible layers of material embedding therein activated charcoal particles.

U.S. Pat. Ser. No. 5,875,775 as a structure which is basically similar to that disclosed in U.S. Pat. No. 4,870,959 with the improvement comprising a one-way respirator adapted for maintaining the mouth and nose spaced apart from the filter portion for efficiently directing breathing efforts to equalize inhalation airflow via substantially all of the filter while the one-way valve eases exhalation airflow and reduces condensation on the interior side of the visor.

It is an object of the present invention to provide a personal protective breathing mask which may be collapsed into a pocket-size package, readily available for use and easily donned to provide a protective breathing device which is affordable and instantly useful in protecting individuals at the event of toxic air, chemical and biologic emergencies.

SUMMARY OF THE INVENTION

It is a primary object of the present invention to provide a protective breathing mask collapsible into a pocket-sized package comprising a hood made of a stretchable fire-resistant material and formed with at least a visor portion and a pair of respiratory units being in flow communication with a chamber formed when the hood is donned, wherein inhalation compels airflow through an inhalation flow path of the respiratory units and exhalation compels easy airflow through the one-way exhaling valve of the respiratory unit.

In accordance with the present invention there is provided a protective breathing hood comprising a hood made of a stretchable fire resistant material and which is also impermeable to gases and biologic material, said hood sized and shaped for placing over a head of a user in an airtight manner with an opening of the hood sealingly engaging a neck portion of the user; at least a visor portion of the hood is transparent; and a pair of respiratory units disposed offset with respect to the nose location; each respiratory unit comprising a housing formed with an inhalation flow path accommodating activated charcoal particles, and an exhalation flow path fitted with a one way exhaling valve, and wherein in a donned position of the hood a chamber is formed at a mouth/nose location thereof.

According to one embodiment of the present invention, the housing comprises an array of receptacles accommodating the charcoal particles; where each receptacle has an inlet opening and an outlet opening and where at least one of the inlet and outlet opening of each receptacle has a cross-section smaller then a cross-section of the receptacle.

In accordance with a particular embodiment, the housing comprises an array of receptacles defined by partitions extending between a proximal wall corresponding with an inside of the hood, and a distant wall corresponding with an outside of the hood; said receptacles accommodating the charcoal particles; the walls comprising openings corresponding with each receptacle and wherein the openings have a cross-section smaller then a cross-section of the receptacle. This arrangement ensures that inhaled air is compelled to flow through activated charcoal particles.

The chamber formed at the mouth/nose location of the hood may be initially formed while production of the hood, e.g. in a molding process. Alternatively, the chamber may be formed by one or more deforming members which at the donned state of the hood deform a portion corresponding with a mouth/nose location of the hood so as to project outwardly and form said chamber.

The deforming member may be made of a rigid though pliable material which may comprise one or more integral hinging portions and which is normally biased into a spaced apart position to thereby span and form said chamber. In accordance with one particular embodiment, the deforming member is articulated to both respiratory units.

The activated charcoal particles is in the form of loose material which may be packed within the receptacle or may be embedded within a bedding material (e.g. sponge material or other carrying matrix) or may be impregnated into a charcoal cloth. The activated charcoal particles may also be formed with a suitable carrying matrix in the form of pellets receivable in the receptacles. Where it is desired to provide also protection against biologic material, the respiratory units further comprise a biologic material barrier disposed in the inhalation flow path. Such barrier material may be, for example, bacteriological filter in a paper-like form and the like.

In accordance with one particular embodiment of the present invention the hood is made of silicon material whereby in accordance with one specific design the entire hood is transparent. Alternatively, a portion of the hood has a distinctive color.

In order to ease mounting of the hood on an individual's head, a sealing neck portion of the hood may be plaited whereby extra material is provided so as to increase stretching of the neck portion and to reduce pressure around the individual's neck at the donned position.

BRIEF DESCRIPTION OF THE DRAWINGS

In order to better understand the invention and to see how it may be carried out in practice, some embodiments will now be illustrated in a non-limiting manner, by way of example only, with reference to the accompanying drawings, in which.

DETAILED DESCRIPTION OF THE INVENTION

Figure 1:
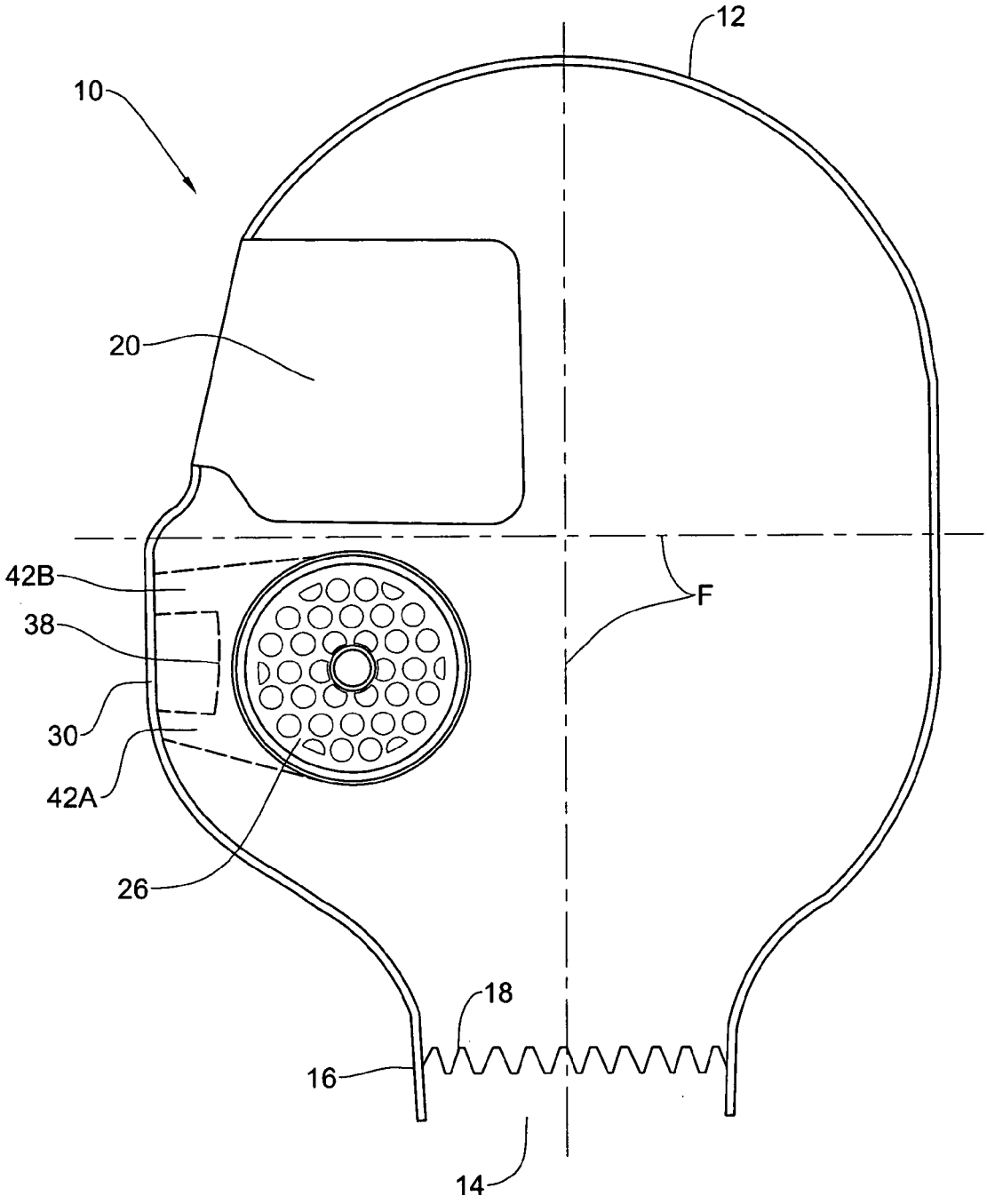
FIG. 1 is a side elevation of a protective breathing hood in accordance with the present invention.
Figure 2A:
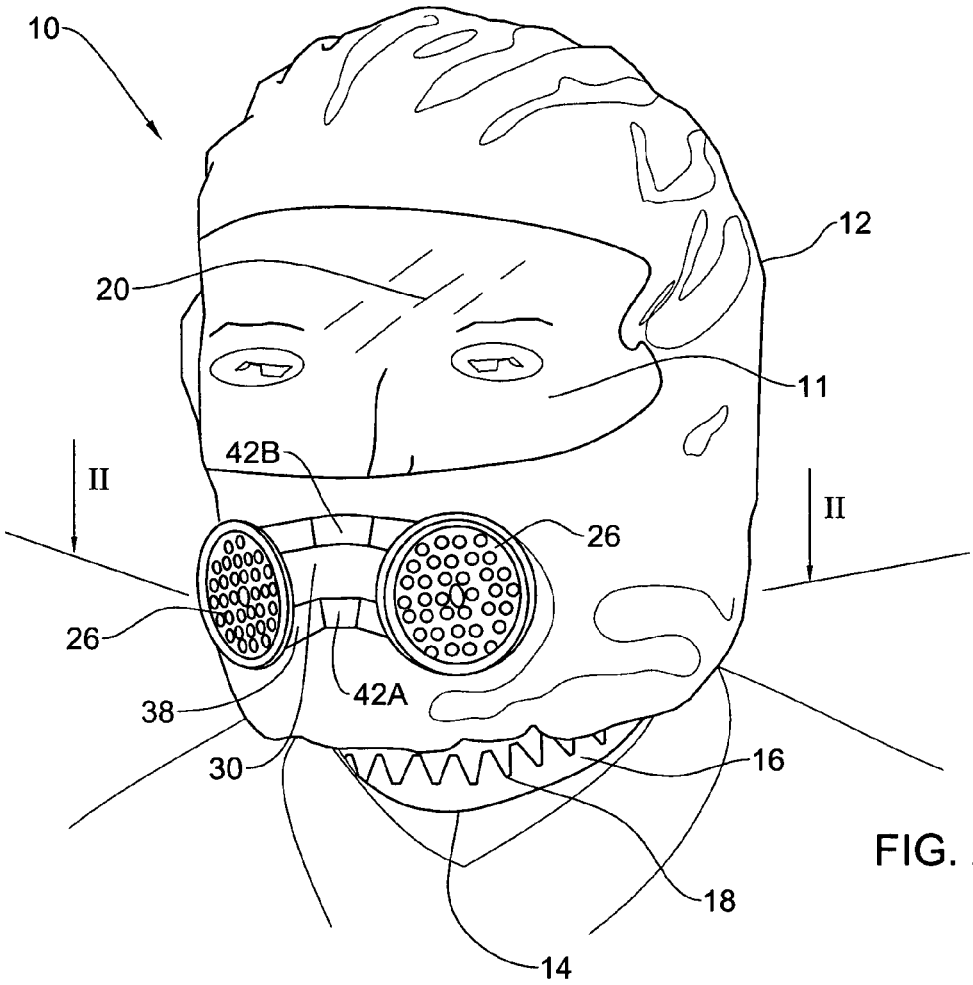
FIG. 2A is an isometric view of a protective hood in accordance with the present invention donned, over an individual's head.

Attention is first directed to FIGS. 1 and 2A of the drawings illustrating the protective breathing hood generally designated 10 which in FIG. 1 is in a flat position and in FIG. 2A is illustrated donned over an individual's head 11.

The protective hood 10 comprises a hood 12 made of a stretchable fire resistant material, e.g. silicon rubber which may resist heat up to about 400 °–600° C. and which is an extremely elastic material whilst being impermeable to gases and biologic material.

The hood 12 has an opening 14 through which the head of an individual is introduced and a neck sealing portion 16 which as illustrated in the figures is plaited at 18 so as to allow good sealing engagement about the individual's neck (see FIG. 2A) whilst not choking the individual or causing an uncomfortable feeling. The arrangement is such that when the hood is donned over a user's head the sealing portion 16 sealingly engages about the user's neck preventing ingress of obnoxious gases or biologic material therethrough.

As can further be illustrated in FIGS. 1 and 2A, the protective hood 10 further comprises a visor 20 which in the present example is a uniform translucent portion extending over both eyes made of a material which is also a heat resistant material.

It is to be appreciated that the visor 20 may be formed in other shapes and forms, e.g. two eye pieces extending opposite the eye locations of the hood or, the arrangement may be such that the entire hood 12 may be transparent and accordingly no particular visor is provided. Alternatively, at least a portion of the hood has a distinctive color. Preferably, at least a visor portion of the hood is transparent.

The protective hood 10 is formed with two respiratory units 26 disposed offset with respect to the nose/mouth location of the individual, indicated in the figures at 30.

The intersecting dashed lined marked F in FIG. 1 indicate a fold line about which the hood may be folded and may be preserved in a sealed, pocket-sized package other folding patterns are possible as well.

Figure 2B:
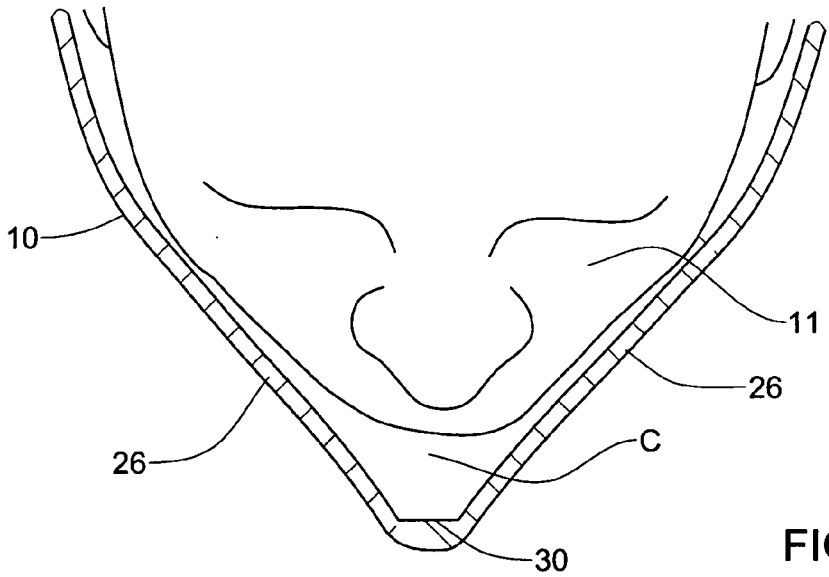
FIG. 2B is a partial view sectioned at II—II in FIG. 2A.

One other important character of the invention noticed in FIGS. 1, 2A and 2B is the deformation of the hood at the nose/mouth location giving rise to forming an internal chamber C (see FIG. 2B) between the nose/mouth location 30 and the individual's face, the purpose of which will become apparent hereinafter. However, it is noticed that the chamber C renders respiratory units 26 to be is in flow communication with the nose and mouth of the individual.

Figure 3A:
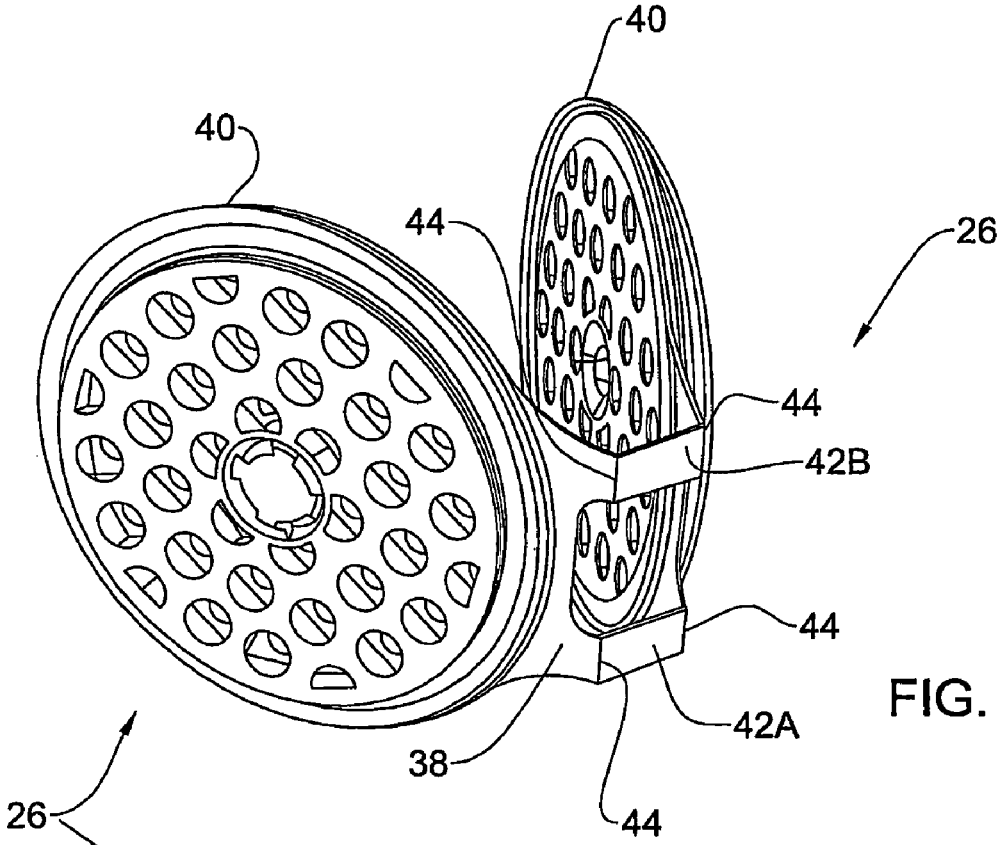
FIG. 3A is a front isometric view of a couple of respiratory units articulated to one another by a deforming member.
Figure 3B:
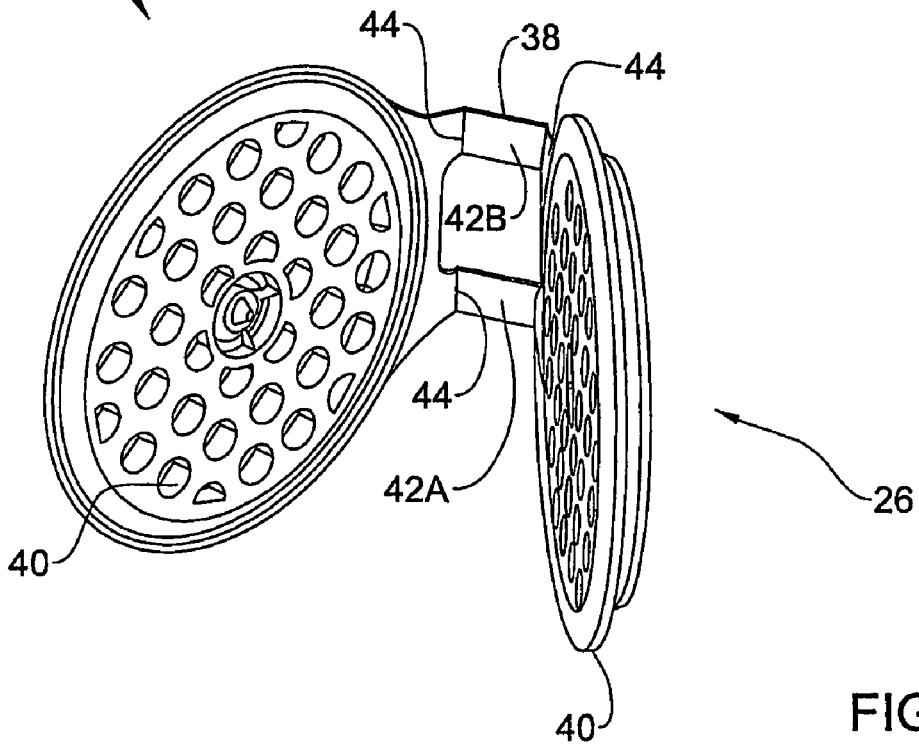
FIG. 3B is a rear isometric view of a couple of respiratory units articulated by a deforming member.

Turning now to FIGS. 3A and 3B, there are illustrated a pair of respiratory units 26 articulated to one another by a supporting member 38. The particular structure of the respiratory units 26 is disclosed hereinafter in detail with reference to FIGS. 4–6.

In the particular embodiment (FIGS. 3A and 3B), deforming member 38 is made of a rigid plastic material formed with two ring-like portions 40 clampingly secured to each of a pair of respiratory units 26, with an intermediate bridging portion consisting of two members 42A and 42B, though other constructions are possible as well and which at the assembled position, while donned over an individual's head, extend at the nose/mouth location to thereby deform the hood 12 giving rise to forming chamber C (see also dashed lines in FIGS. 1 and 2A). Bridging portions 42A and 42B are interconnected to the circular portions by integral hinges at 44. For the sake of clarity, the supporting member 38 is illustrated also in FIGS. 1 and 2A, by dashed lines.

Whilst in FIGS. 1 to 3 the deforming member 38 is in the form of a rigid member extending between the two respiratory units, other arrangements for deformation of the mask may be employed as well, for the sake of forming a chamber C. For example, the respective nose/mouth portion 30 may be provided with deforming ribs. Such ribs (not shown) may be integrally molded during the process of molding the hood, e.g. made of silicon, or may be attached thereto by other means, e.g. adhering or welding (e.g. heat or sonic, etc) the ribs may be made of a rigid material other than that of the hood or may constitute an integral part thereof.

Figure 4:
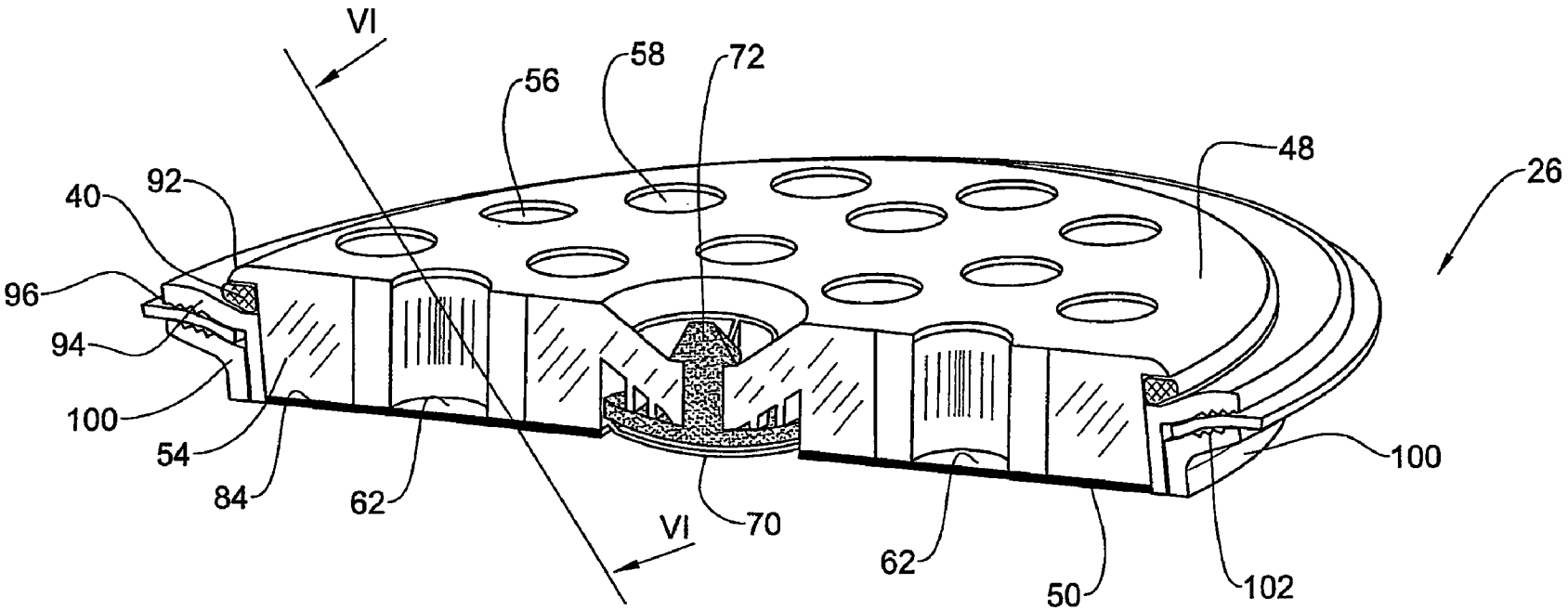
FIG. 4 is a partially sectioned isometric view, from an inside, of a respiratory unit in accordance with the present invention.
Figure 5:
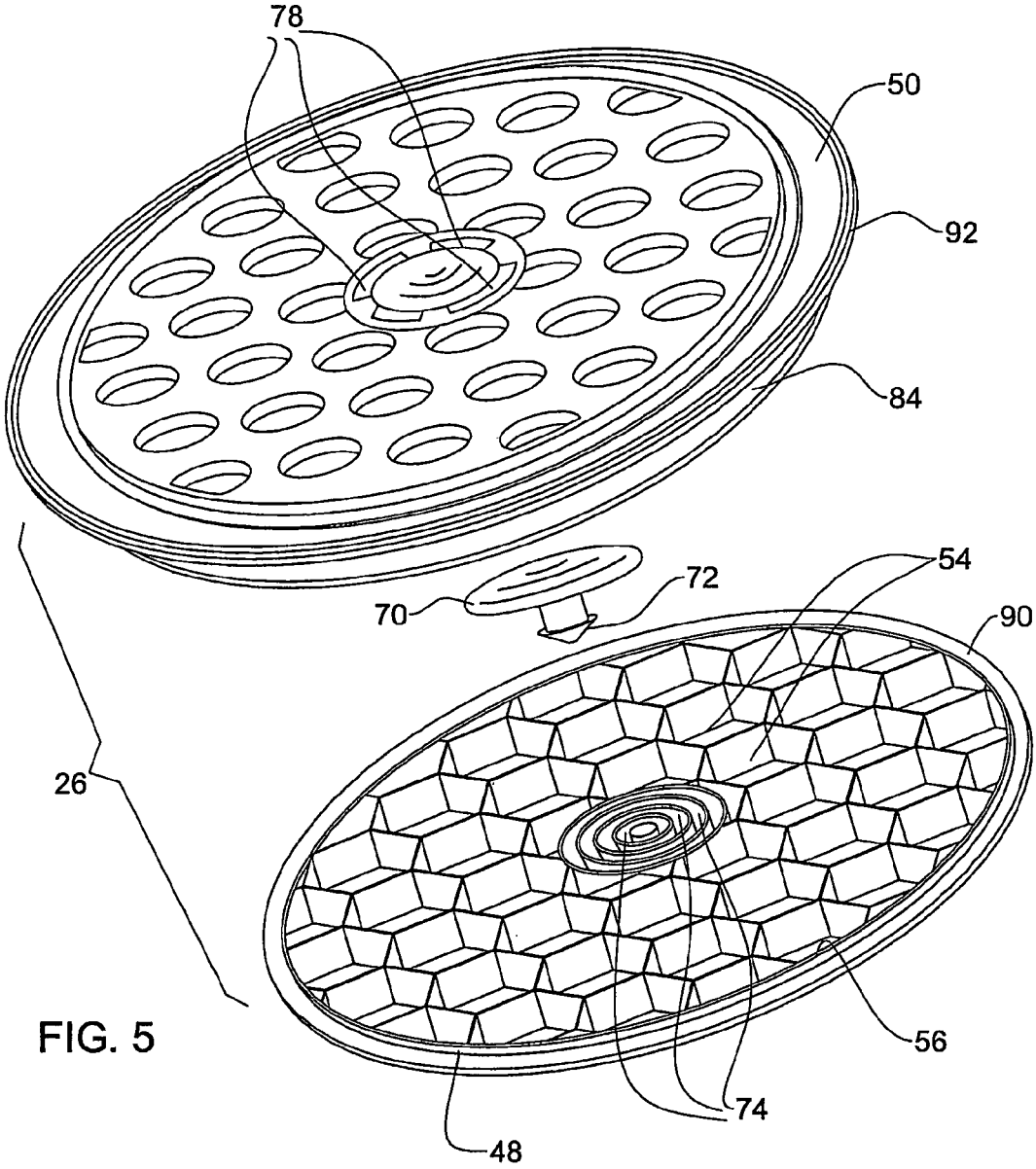
FIG. 5 is an exploded isometric view of a respiratory unit in accordance with the present invention.
Figure 6:
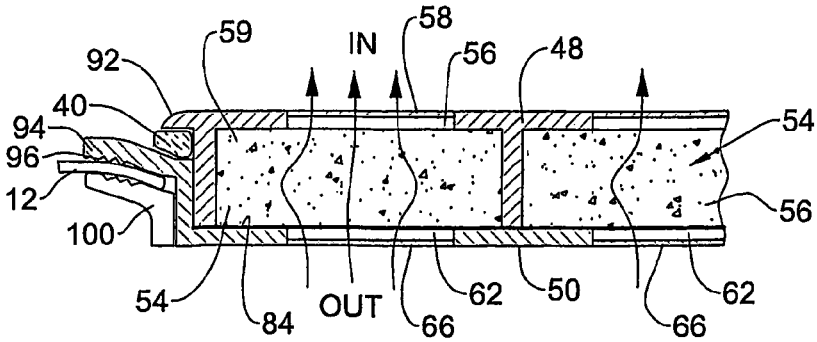
FIG. 6 is a section through a portion marked VI—VI in FIG. 4, also illustrating gas flow through the respiratory unit.

Further attention is now directed to FIGS. 4–6 for understanding the assembly and mode of operation of the respiratory units 26. In the present embodiment, each of the respiratory units comprises a multi-receptacle member 48 facing the inside of the protective hood and a cover member 50 facing the outside of the hood. Multi-receptacle member 48 is formed with a plurality of receptacles 54 which in the present example have the shape of a honeycomb and a hexagonal section, though other shapes are possible as well, e.g. circular, etc. Each of the receptacles 54 has an outlet opening 56 which is covered by a fine grid 58, so as to prevent outflow of the activated charcoal particles recovered within the receptacles 54. Cover member 50 is similarly formed with a plurality of inlet openings, each such openings fitted with a fine grid 66 also serving to prevent outflow of the activated charcoal particles 59 (seen in FIG. 6) received within the receptacles 54.

The activated charcoal particles are in the form of loose granulated material. By way of example, the size of the loose granulated activated charcoal particles is about 0.5 to 1 mm.

The activated charcoal particles may also be formed with a suitable carrying matrix in the form of pellets receivable in the receptacles.

Co-axially received within each respiratory unit 26 there is a one-way exhaling valve 70 which is in the form of a mushroom-type membrane valve with a stem member 72 snapingly received within a central opening formed at the multi-receptacle member 48. A plurality of exhaling apertures 74 are formed in the multi-receptacle member 48 to facilitate flow of exhaled gases from the chamber C of the protective hood to the surrounding environment, after deforming the mushroom-type valve and then via the outlet apertures 78 formed in the cover member 50.

Typically, the respiratory units 26 are also fitted with a biologic-material barrier in the form of filtering paper 84 (which for the sake of convenience and practicality is in the form of a single sheet though other arrangements are available as well, e.g. individual pieces received in each of the receptacles 54).

Whilst in the present example, the receptacles 54 are stuffed with particulated activated charcoal 59 (FIG. 6), it is to be appreciated other forms of gas treating media is possible as well, e.g. uniform or layers of impregnated charcoal cloth or other charcoal carrying media, e.g. particulated charcoal embedded within non woven material, e.g. in the form of pellets, etc.

As can best be seen in FIGS. 4 and 6, the size of inlet opening 62 and outlet openings 56 is smaller than the actual size of the receptacles 54. This arrangement ensures that inflow through the respiratory units is continuously treated and obnoxious material is absorbed by the activated charcoal particles 59 obviating the need for thick filtration material on the one hand and on the other hand, providing extended effective use/filtration.

As can further be seen in FIGS. 4 and 6, the receptacle member 92 is formed with an annular rim 90 and the cover member 50 is formed with a corresponding annular rim 94, the latter provided with gripping teeth 96 at a outward facing portion thereof. The arrangement is such that at the assembled position the circular portion 40 of the deforming member 38 is clampingly received between rim portions 92 and 94. A retaining ring 100 has a plurality of annular teeth 102 corresponding with teeth 96 of the rim 94 and is adapted for clampingly receiving therebetween respective portions of the hood 12 (FIG. 6) wherein the ring 100 is snapingly secured over the periphery of the cover member 50.

Reverting now to the issue of chamber C formed in the protective hood in accordance with the present invention, as illustrated, for example in FIGS. 1 and 2, it is to be appreciated that such a chamber is advantageous as it minimizes the feeling of suffocation in case such a protective hood is stretched over an individual's breathing organisms (nose and mouth). Furthermore, the construction of a chamber (at times referred to as a breathing chamber, mixing chamber, speaking chamber, and other similar terms) enables an individual wearing the protective hood to speak clearly. This is not facilitated in case of a hood which is stretched over the individual's mouth. Still another advantage of the chamber resides in that the individual may breathe freely without having to direct the exhaled gases through an particular outlet opening in which case speech becomes complicated or impossible.

The invention claimed is:

1. A protective breathing hood comprising:

a hood made of a stretchable fire resistant material and which is also impermeable to gases and biologic material, said hood sized and shaped for placing over a head of a user in an airtight manner with an opening of the hood sealingly engaging a neck portion of the user;

at least a visor portion of the hood is transparent;

a pair of respiratory units disposed offset with respect to the nose location; each respiratory unit comprising a housing formed with an inhalation flow path accommodating activated charcoal particles and comprising an array of receptacles defined by partitions extending between a proximal wall corresponding with an inside of the hood, and a distant wall corresponding with an outside of the hood; said receptacles accommodating the charcoal particles;

the walls comprising openings corresponding with each receptacle and wherein the openings have a cross-section smaller than a cross-section of the receptacle; and the protective breathing hood further comprising an exhalation flow path fitted with a one way exhaling valve, and wherein in a donned position of the breathing hood a chamber is formed at a mouth/nose location thereof.

2. A protective breathing hood according to claim 1, wherein the partitions are integral with one of the proximal wall and the distant wall.

3. A protective breathing hood according to claim 1, wherein the activated charcoal particles are loose material packed within suitable receptacles.

4. A protective breathing hood according to claim 3, wherein the receptacles are disposed in the form of a honeycomb.

5. A protective breathing hood according to claim 3, wherein the receptacles have a hexagonal cross-section.

6. A protective breathing hood according to claim 3, wherein the receptacles have a circular cross-section.

7. A protective breathing hood according to claim 3, wherein the loose activated charcoal particles is granulated material.

8. A protective breathing hood according to claim 7, wherein the size of the loose granulated activated charcoal particles is about 0.5 to 1 mm.

9. A protective breathing hood according to claim 1, wherein the activated charcoal particles are loose material embedded within a bedding material received within housing.

10. A protective breathing hood according to claim 9 wherein the activated charcoal particles are impregnated in a charcoal cloth.

11. A protective breathing hood according to claim 1, wherein the visor portion is integrally formed with the hood.

12. A protective breathing hood according to claim 1, wherein the hood is entirely transparent.

13. A protective breathing hood according to claim 1, wherein the hood is provided with one or more deforming members for deforming the hood so as to form the chamber at a mouth/nose location of the hood.

14. A protective breathing hood according to claim 13, wherein the deforming member is made of a rigid though pliable material.

15. A protective breathing hood according to claim 14, wherein the deforming member is articulated to both respiratory units and is foldable about an integral hinge formed at a middle portion thereof.

16. A protective breathing hood according to claim 15, wherein the deforming member comprises two arms, each articulated to a respective respiratory unit and being normally biased into a spaced apart position.

17. A protective breathing hood according to claim 13, wherein the one or more deforming members are reinforced ribs integrally formed with the hood.

18. A protective breathing hood according to claim 17, wherein the hood is integrally molded with the reinforced ribs.

19. A protective breathing hood according to claim 1, wherein the the respiratory units are sealingly fitted within an opening formed in the hood and fixed to the hood by a snap-type engagement.

20. A protective breathing hood according to claim 1, wherein a sealing neck portion of the hood is axially plaited.

21. A protective breathing hood according to claim 1, wherein the air exhalation flow path and the inhalation flow path are coaxially disposed within a respiratory unit.

22. A protective breathing hood according to claim 1, wherein the respiratory units further comprise a biologic material barrier disposed in the inhalation flow path.

23. A protective breathing hood according to claim 1, foldable into a pocket-sized package.

24. A protective breathing hood according to claim 1, wherein at least a portion of the hood has a distinctive color.

25. A protective hood according to claim 1, wherein the hood is made of silicone rubber.

26. A protective breathing hood according to claim 25, wherein the entire hood is transparent.

27. A protective hood according to claim 1, wherein the exhaling valve is a mushroom-type valve fitted into the housing.

28. A protective hood according to claim 1, being a disposable one.

29. A protective breathing hood comprising according to claim 1, wherein the exhalation flow path is in fluid communication with the mouth/nose of the user at least when the exhalation valve is open.

30. A protective breathing hood comprising:

a hood made of a stretchable fire resistant material and which is also impermeable to gases and biologic material, said hood sized and shaped for placing over a head of a user in an airtight manner with an opening of the hood sealingly engaging a neck portion of the user;

at least a visor portion of the hood is transparent;

a pair of respiratory units disposed offset with respect to the nose location;

each respiratory unit comprising a housing formed with an inhalation flow path accommodating activated charcoal particles, and an exhalation flow path fitted with a one way exhaling valve, the housing comprising an array of receptacles accommodating the charcoal particles; and each respiratory unit comprising a housing formed with an inhalation flow path accommodating activated charcoal particles, and an exhalation flow path fitted with a one way exhaling valve, the housing comprising an array of receptacles accommodating the charcoal particles; where each receptacle having an inlet opening and an outlet opening and where at least one of the inlet and outlet opening of each receptacle has a cross-section smaller then a cross-section of the receptacle, and wherein in a donned position of the breathing hood a chamber is formed at a mouth/nose location thereof.

31. A protective breathing hood according to claim 30, wherein the openings are fitted with a grid.

* * * * *